US005468925A

United States Patent [19]

Mohsen

[11] Patent Number: 5,468,925

[45] Date of Patent: Nov. 21, 1995

[54] ENCLOSURE FOR AN ELECTRICAL SWITCH

[76] Inventor: Jafar Mohsen, 409 Honker La., Suisun City, Calif. 94585

[21] Appl. No.: 231,023

[22] Filed: Apr. 21, 1994

[51] Int. Cl.[6] ..... H01H 9/28

[52] U.S. Cl. ..... 200/43.22; 200/43.11; 200/43.16; 70/203; 70/DIG. 30

[58] Field of Search ..... 200/43.22, 43.01, 200/43.03, 43.11, 43.14, 43.15, 43.16, 43.18, 43.21, 330, 331, 332.1, 333; 70/202, 203, DIG. 30

[56] References Cited

U.S. PATENT DOCUMENTS

| | | | |
|---|---|---|---|
| 1,168,066 | 1/1916 | Girardot | 200/43.22 |
| 3,816,677 | 6/1974 | Soltez | 200/43.11 |
| 4,121,065 | 10/1978 | Woodard | 200/42 |
| 4,467,152 | 8/1984 | Gordy | 200/42 |
| 4,733,029 | 3/1988 | Kobayashi et al. | 200/43.15 |
| 4,882,456 | 11/1989 | Hovanic et al. | 200/43 |
| 4,978,816 | 12/1990 | Castonguay et al. | 200/43.14 |
| 5,122,624 | 6/1992 | Benda | 200/43 |
| 5,260,528 | 11/1993 | Benda | 200/43.14 |

*Primary Examiner*—Henry J. Recla
*Assistant Examiner*—David J. Walczak
*Attorney, Agent, or Firm*—Harold D. Messner

[57] ABSTRACT

An actuator switch enclosure utilizing a plate capable of being positioned against the cover of the electrical switch actuator. A holder is also included in the present invention for maintaining the position of the plate against the associated cover utilizing fastener openings in the cover. A flap is attached to the plate and is capable of moving into a position where the flap is at least partially against the plate. The flap further possesses a pair of compartments for enclosing switch actuators of different types and preventing the same from being employed. The flap is secured to the plate to prevent unauthorized opening of the same.

10 Claims, 2 Drawing Sheets

ENCLOSURE FOR AN ELECTRICAL SWITCH

CROSS-REFERENCES RELATION APPLICATIONS

The present application is related to my prior application, Ser. No. 08/073,130, Filed 7 Jun. 1993, now abandoned.

BACKGROUND OF THE INVENTION

The present invention relates to a novel enclosure for an electrical switch actuator.

Electrical systems in buildings and vehicles often require maintenance and repair activities. Generally, one must deactivate an electrical system through a central panel which is normally located remotely from the work place, perform the repair on the electrical system, and return to the central panel system to reactivate the system. Often, one must return several times to the central panel in order to provide interim electrical power during a repair. Although this method is inefficient, it is considered to be safe since the central panel can normally be locked or otherwise be rendered inaccessible to other persons who may inadvertently activate the system and cause injury to the electrical worker. In fact, industry standards require electrical workers to lock access ports to electrical circuits when electrical repairs and maintenance takes place.

Local switches, such as toggle switches, which are normally wall mounted may also be employed to activate or deactivate a circuit within a room of a building. However, a sign or other device must be employed to prevent activation or reactivation of this circuit while work is being performed on the same.

U.S. Pat. Nos. 4,121,065 and 4,882,456 describe locking devices for switch levers which employ pertinent devices such as locking pins and plates which physically prevent the operation of a switch actuator.

U.S. Pat. Nos. 4,467,152, 4,733,029, and 5,122,624 show switch interrupters which employ collars or open plates to confine the movement of the switch actuator. Although useable, such type of devices do not protect the actuator switch which is susceptible to damage during the maintenance and repair work on the circuitry.

A switch actuator locking enclosure which successfully prevents the movement of the switch and protects the same from damage would be a notable advance in the electrical repair field.

SUMMARY OF THE INVENTION

In accordance with the present invention a novel and useful enclosure for an electrical switch actuator is herein described.

The enclosure employs as one of its elements a plate which is capable of being positioned against the cover associated with the electrical switch actuator. The plate, which may be counterbored, is positioned to flush against the existing cover by holding means which maintains the plate in such a position. It should be noted that the plate includes openings or slots which permits the use of the existing screws found in a cover for a switch actuator or employ auxiliary fasteners, such as longer screws, for this purpose. The plate and enclosure are also fastened to the switch mechanism which provides threaded openings.

The invention also includes holding means for maintaining the positioning of the plate against the cover associated with the switch actuator. Such holding means may take the form of openings in the plate and may be slotted to provide versatility in alignment of the plate with the fasteners found in the cover associated with the switch actuator. In this regard, the openings in the plate are alignable with the associated cover fastener openings. By this expedient, securing means, such as set screws, may be employed to hold the plate to the cover associated with the electrical switch actuator.

A flap also constitutes part of the present invention. Such flap is linked attached to the plate and is capable of lying against the plate in one position or moved away from the plate in another position. Such flap may be rotatably attached to the plate. The switch actuator would be accessible for operation when the flap is away from the plate. The flap is formed with a pair of compartments that are capable of enclosing switch actuators of different types and at least partially covering the same. Presumptively, only one type of switch actuator is enclosed at a particular time. Nevertheless, the compartments prevent on-off movement of the switch actuator when the flap lies against the plate in one position. The compartments may be formed in many shapes to conform to the particular type of switch actuator being protected. For example, one of the flap compartments may have an angled surface which is contiguous with a separate angled surface relative to an end flange. In certain embodiments, the flap outer surface may include storage means for confining fasteners to the same. Such fasteners may be used in substitution for the existing fasteners of the cover plate associated with the electrical switch actuator. The flap compartments may also include exposed side portions such that the switch actuators are protected and confined, but visible to the user of the enclosing device of the present invention.

The present invention also includes securing means for preventing rotation of the flap. The securing means may be constructed in the form of the plate and flap each including a flange having openings therethrough to commonly accommodate a padlock bail. In addition, the plate may be formed with a hasp while the flap may include a complimentary slot for cooperation with the hasp. It should be understood that other structures may be employed in this regard to confine the movement or rotation of the flap relative to the plate.

It may be apparent that a new and useful enclosure for an electrical switch actuator has been heretofore described.

It is therefore an object of the present invention to provide an enclosure for a switch actuator which is usable in conjunction with a standard cover plate associated with a standard switch actuator without removal of the cover plate from the electrical box.

It is another object of the present invention to provide an enclosure for an electrical switch actuator which is easily secured to prevent unauthorized manipulation of the electrical switch actuator confined against use by the enclosure of the present invention.

Yet another object of the present invention is to provide an electrical switch actuator enclosure which is versatile for use with switch actuators of varying configurations.

Another object of the present invention is to provide an enclosure for an electrical switch actuator which is simple to manufacture.

A further object of the present invention is to provide an enclosure for an electrical actuator which is capable of covering multiple switch actuators in ganged configuration.

Another object of the present invention is to provide an enclosure for an electrical actuator which fixes the actuator in an open or closed position by reversing the position of the enclosure relative to the actuator cover.

The invention possesses other objects and advantages especially as concerns particular characteristics and features thereof which will become apparent as the specification continues.

For a better understanding of the invention reference is made to the following detailed description of the preferred embodiments thereof which should be referenced to the prior described drawings.

DESCRIPTION OF THE PREFERRED EMBODIMENTS

Various aspects of the present invention will evolve from the following detailed description of the preferred embodiments thereof which should be taken with the drawings, prior described.

Figure 4:
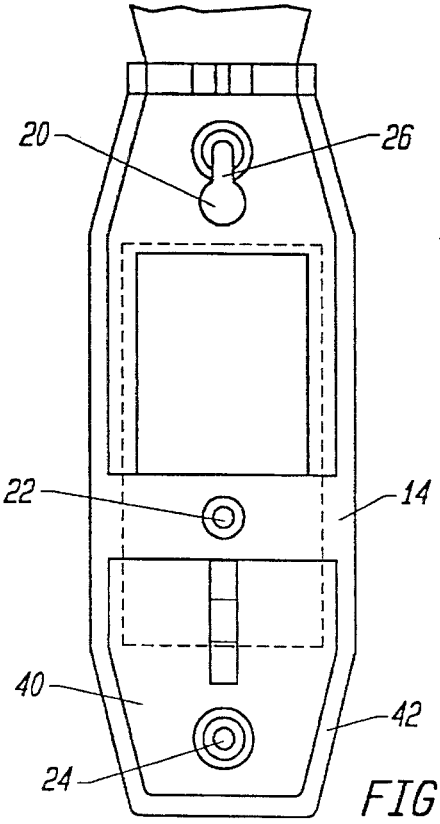
FIG. 4 is a front elevational view taken along line 4—4 of FIG. 3.

The invention as a whole is shown by reference character 10. The enclosure 10 includes as one of its elements a plate 12 which may constructed of any rigid or semi-rigid material such as metal, plastic, wood, or the like. Plate 12 includes a front surface 14 and a rear surface 16, FIGS. 2 and 3. Rear surface 16 includes a counterbore or recess 18. Openings 20, 22, and 24 pass through plate 12, the function of which will be discussed hereinafter. Aperture 20 includes a channel or slot 26, FIG. 4. Hasp 28 also extends from plate 20 and includes an opening 30, FIG. 3, to accept the bail 32 of a padlock 34, shown in phantom on FIG. 2.

Figure 1:
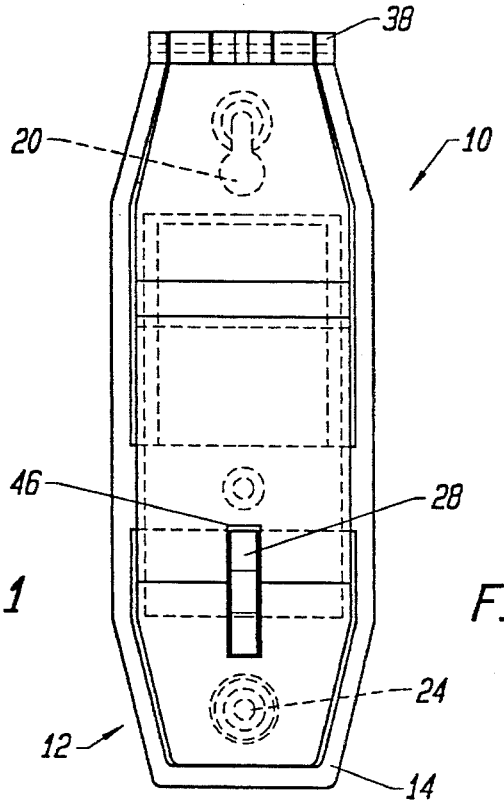
FIG. 1 is a top front elevational view of an embodiment of the present invention depicting the flap against the plate portion of the invention.
Figure 2:
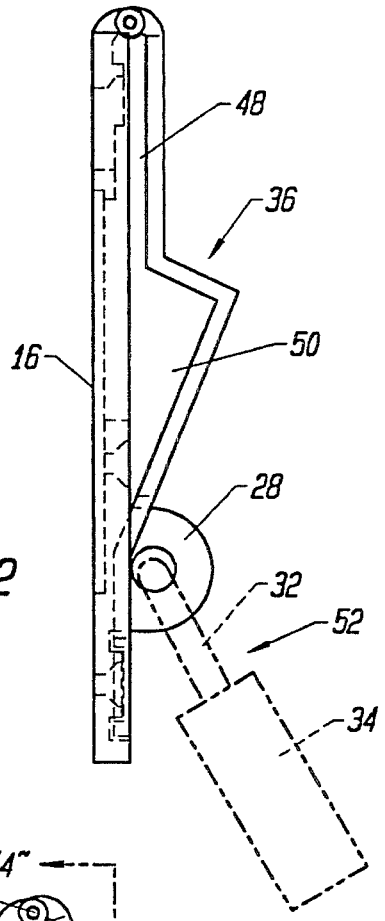
FIG. 2 is a side elevational view of the FIG. 1 embodiment of the present invention with the flap depicted against from the plate portion thereof.
Figure 3:
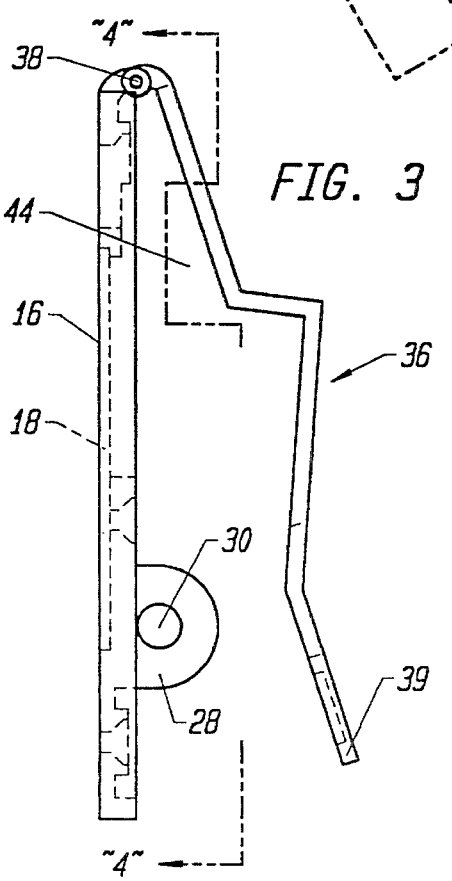
FIG. 3 is a side view of an alternate embodiment from that depicted in FIG. 2 with the flap shown in a position apart from the plate.

A flap 36 is also illustrated in the drawings as being a portion of enclosure 10. Flap 36 is linked to plate 12 by hinge 38 and is movable relative to plate 12 thereby. With reference to FIGS. 2 and 3, it may be observed that flap 36 includes a flange portion 39 that rests against the depressed surface 40 on front surface 14 of plate 12 formed by a wall 42 which extends around front surface 14 of plate 12. It should be noted that FIG. 3 depicts an alternate embodiment of enclosure 10 in which wall 42 is formed with a shoulder or recess 44, best shown in FIG. 3. Turning again to FIGS. 1 and 2, it be observed that flap 36 includes a slot 46 which allows the passage of hasp 28, such that flap 36 may be locked relative to plate 12. Flap 36 also includes a first compartment 48 and an adjacent second compartment 50, which is triangular-shaped in cross section. FIG. 2 reveals that when flap 36 is locked to plate 12, compartment 50 has open visible side portions. Thus, the combination of hasp 28, slot 46, and padlock 34 constitutes holding means 52 for preventing movement of flap 36 relative to plate 12.

Figure 5:
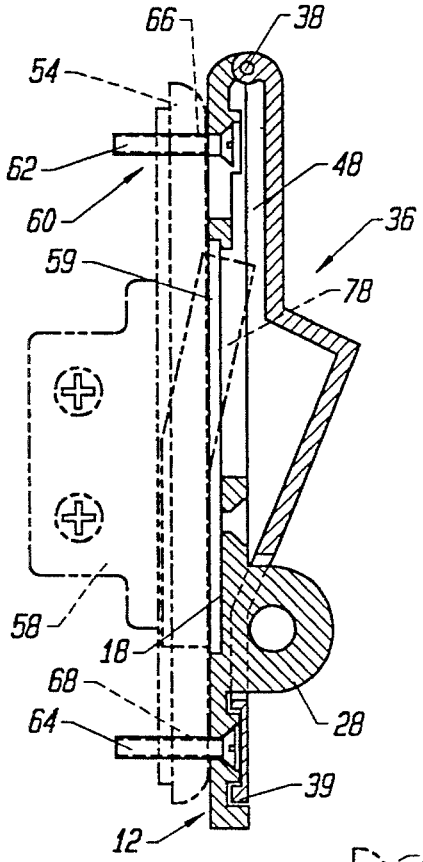
FIG. 5 is a sectional view of the invention depicted in FIG. 2, in a closed position and being used with a rocker switch, shown in phantom in an on "OFF" position.
Figure 6:
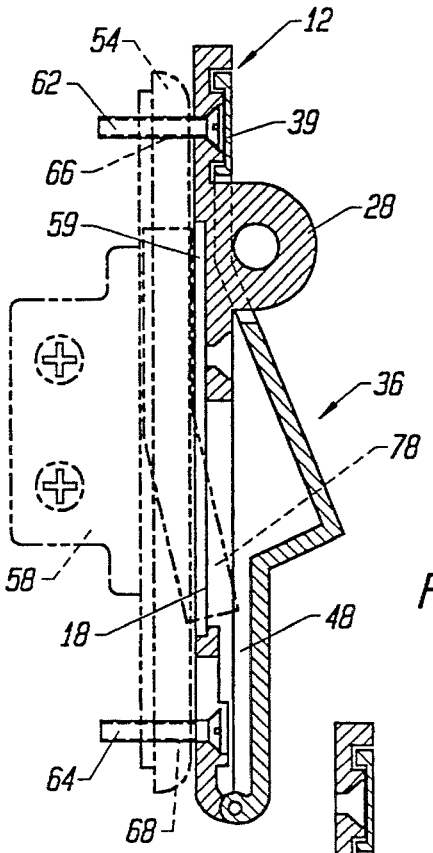
FIG. 6 is a sectional view of the invention depicted as reversed from FIG. 2 in a closed position and being used with a rocker switch, shown in phantom, in an "ON" position.
Figure 7:
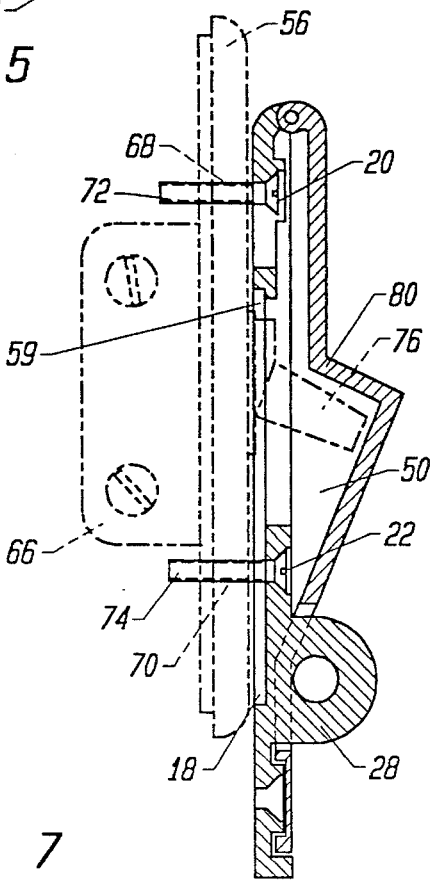
FIG. 7 is a sectional view of the invention depicted in FIG. 2 in a closed position and being used with a toggle switch, shown in phantom, in an "OFF" position.
Figure 8:
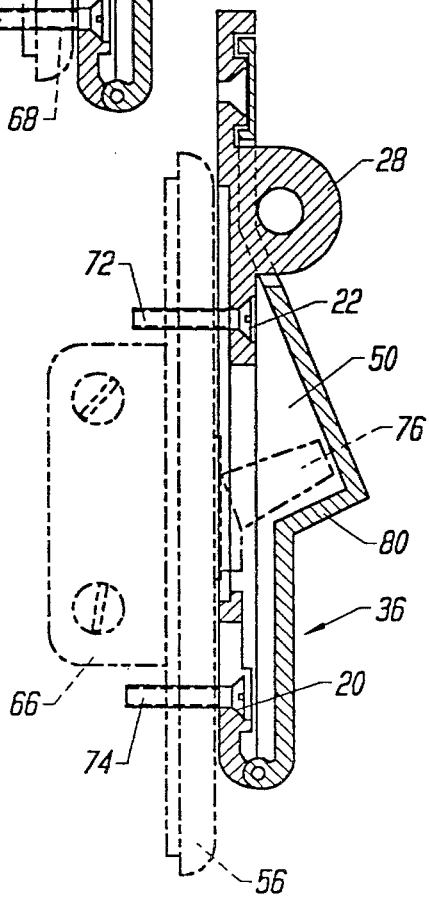
FIG. 8 is a sectional view of the invention depicted as reversed from FIG. 2, in closed position, and being used with a toggle switch, shown in phantom, in an "ON" position.

With reference relative to FIGS. 5–8, it be seen that enclosure 10 is easily positioned to cover 54, FIGS. 5 and 6, or to cover 56, FIGS. 7 and 8. Cover 54 is conventionally employed with a rocker switch 58, which is a commercially available product. Normally, rocker switch 58 is used to actuate electrical circuits including lighting, ventilation, and the like. As depicted in FIG. 5, rocker switch is in the OFF position. Plate 12 is held to cover 54 by holding means 60. Collar 59 of rocker switch 58 fits within recess 18. Holding means 60 includes screw fasteners 62 and 64 which pass through openings 20 and 24 as well as openings 66 and 68 through cover 54. Fasteners 62 and 64 also engage aligned openings in rocker switch 58 such that enclosure 10, cover 54, and rocker switch 58 form a unit. Of course, flap 36 is free to move about hinge 38.

With reference to FIG. 6, it may be observed that enclosure 10 is fastened to cover 54 in a similar manner except that enclosure 10 has been reversed such that hasp 28 lies upwardly. Again, fasteners 62 and 64 employ the appropriate openings in plate 12, cover 54, and rocker switch 58. It should be noted that rocker switch 58 is now in the ON position and is maintained in that position by enclosure 10.

FIGS. 7 and 8 represent the use of a enclosure 10 with toggle switch 66 such that openings 20 and 22 of plate 12 are employed with openings 68 and 70 of cover 56', as well as aligned openings found in toggle switch 66. Threaded fasteners 72 and 74 engage such openings and hold enclosure 10, cover 56, and toggle switch 66 as a unit. Toggle 76 extends into second compartment 50 of enclosure 10 and is shown in the OFF position in FIG. 7. FIG. 8 depicts enclosure 10 attached to cover 56 and toggle switch 66 in a reverse position from FIG. 7 such that hasp portion 28 is oriented upwardly. Toggle 76 is found in the ON position in FIG. 8.

In operation, the user removes fasteners that hold cover 54 or 56 to rocker switch 58 or toggle switch 66, respectively. With reference to rocker switch 58, threaded fasteners 62 and 64 are employed to hold plate 12 to cover 54 and to rocker switch 58 through the use of aligned openings 20 and 24 of plate 12, 66 and 68 of cover 54, and threaded openings provided by rocker switch 58. With respect to FIG. 6, enclosure 10 is reversed such from the orientation depicted in FIG. 5 such that opening 24 of plate 12, opening 66 of cover 54, and a threaded opening in rocker switch 58 are employed in conjunction with threaded fasteners 62. Opening 20 of plate 12, opening 68 of cover 54, and an opening provided by rocker switch 58 are used with threaded fasteners 64. In FIG. 5, the rocker actuator 78 lies in compartment 48 and is prevented from moving substantially by flange 39 of flap 36 at recess 18. Rocker actuator 78 is visible when viewed from the side to the user of enclosure 10. In FIG. 6, rocker actuator 78 has been maintained in the ON position so that a portion of rocker actuator 78 lies in compartment 48. Again, flange 39 at recess 18 prevents substantial movement of rocker 78. In FIG. 7, enclosure 10 is used in conjunction with toggle switch 66 such that openings 20 of plate 12, opening 68 of cover 56 and a normally threaded opening provided by toggle switch 66 are employed with threaded fastener 72. Likewise, threaded fastener 70 utilizes opening 22 of plate 12, opening 70 of cover 56 and an opening provided by toggle switch 66. Hasp portion lies downwardly in FIG. 7 such that toggle 76 is placed within compartment 50 in the OFF position. Wall portion 80 of flap 36 prevents toggle 76 from rotating upwardly to the ON position. Reversing enclosure 10 in FIG. 8, it may be apparent that fasteners 72 and 74 are again employed. The former utilizes openings 22 of plate 12, openings 68 of cover 56, and a threaded opening provided by toggle switch 66. Threaded fastener 74 passes through opening 20 of plate 12, opening 70 of cover 56, and an opening provided by toggle switch 66. The result in orientation of toggle 76 in FIG. 8 is that toggle 76 lies in compartment 50 in the ON position and is prevented by flap wall portion 80 from rotating downwardly into the OFF position. It has been found that enclosure 10 is versatile and may be employed with virtually all wall switches of conventional construction. In certain cases existing fasteners for covers 54 and 56 may be utilized while in other cases, longer fasteners such as fasteners 62, 64, 72, and 74 must be substituted for the existing fasteners to utilize enclosure 10 as depicted in FIGS. 5–8.

While in the foregoing, embodiments of the invention have been set forth in considerable detail for the purposes of making a complete disclosure of the invention. It may be apparent to those of skill in the art that numerous changes may be made in such details without department from the spirit and principles of the invention.

What is claimed is

1. An enclosure selectively usable for one of a plurality of electrical switch actuators movable between first and second opposite actuator positions, and associated cover secured thereto by at least one exposed fastener extending through a fasterner opening in said cover, a first of said actuators movable in a first predetermined path and a second of said actuators movable in a second predetermined path different from said first predetermined path comprising:

a. a plate, said plate being capable of being positioned against the cover associated with the electrical switch actuator;

b. holding means for selectively maintaining said positioning of said plate against the cover associated with the electrical switch actuator in a first position corresponding to said first actuator position and in a second position inverted from said first position corresponding to said second actuator position said holding means adapted to cooperate with said exposed fastener of the cover associated with the switch actuator;

c. a flap, said flap being linked to said plate and being movable relative to said plate to selectively lie against the plate and to lie away from said plate, said flap having a first wall portion defining a first compartment adapted to intersect said first predetermined path and having a second wall portion defining an adjacent second compartment adapted to intersect said second predetermined path, said respective wall portions defining stop means for preventing movement of a selected switch actuator when said plate is selectively positioned in said first position and said second position inverted from said first position; and d. securing means for preventing movement of said flap relative to said plate when said plate is selectively positioned in said first position and said second position inverted from said first position.

2. The enclosure of claim 1 in which said securing means includes a slot in said flap and said plate includes a protuberance extendable through said slot of said flap.

3. The enclosure of claim 2 in which said plate includes at least one opening alignable with the exposed fastener opening of the switch actuator cover.

4. The enclosure of claim 1 in which said flap further comprises a flange extending from said second compartment and being capable of contacting said plate.

5. The enclosure of claim 1 in which said second compartment is triangular in cross section.

6. The enclosure of claim 1 in which said second compartment possesses an open side portion.

7. The enclosure of claim 6 in which said first compartment possesses an open side portion.

8. The enclosure of claim 1 in which said flap is hingedly attached to said plate.

9. The enclosure of claim 1 in which said plate includes a plurality of openings at least two of which are alignable with exposed fastener openings of the cover.

10. The enclosure of claim 1 in which said plate includes a recess for at least partially enclosing said switch actuator.

* * * * *